US006307327B1

(12) United States Patent
Xie et al.

(10) Patent No.: US 6,307,327 B1
(45) Date of Patent: Oct. 23, 2001

(54) METHOD FOR CONTROLLING SPACER VISIBILITY

(75) Inventors: Chenggang Xie, Phoenix, AZ (US); Ken K. Foo, Grayslake, IL (US)

(73) Assignee: MOtorola, Inc., Schaumburg, IL (US)

( * ) Notice: Subject to any disclaimer, the term of this patent is extended or adjusted under 35 U.S.C. 154(b) by 0 days.

(21) Appl. No.: 09/491,996

(22) Filed: Jan. 26, 2000

(51) Int. Cl.[7] ..... H01J 1/30

(52) U.S. Cl. ..... 315/169.4; 313/495; 313/481; 313/292; 345/1

(58) Field of Search ..... 315/169.1–169.4, 315/366; 313/495, 292, 309, 481, 482, 500; 345/1, 41, 46, 48, 50, 104

(56) References Cited

U.S. PATENT DOCUMENTS 5,859,497 * 1/1999 Anderson et al. ..... 313/309
5,864,205 * 1/1999 Dworsky ..... 313/292
5,894,193 * 4/1999 Amrine et al. ..... 313/481
6,013,981 * 1/2000 Spindt et al. ..... 313/292
6,046,539 * 4/2000 Haven et al. ..... 313/495
6,097,139 * 8/2000 Tuck et al. ..... 313/495
6,133,969 * 10/2000 Babuka et al. ..... 345/1

* cited by examiner

*Primary Examiner*—Don Wong
*Assistant Examiner*—Wilson Lee
(74) *Attorney, Agent, or Firm*—Kevin D. Wills

(57) ABSTRACT

A method for controlling spacer (108) visibility in a field emission display (100) includes the steps of modifying pixel data for transmission to a plurality of pixels (110) in a first region (112) adjacent to a spacer (108) to render the spacer (108) invisible to a viewer of the field emission display (100). A field emission display (100) with a spacer visibility correction circuit (104) that modifies pixel data for transmission to a plurality of pixels (110) in a first region (112) adjacent to a spacer (108).

19 Claims, 3 Drawing Sheets

100

100

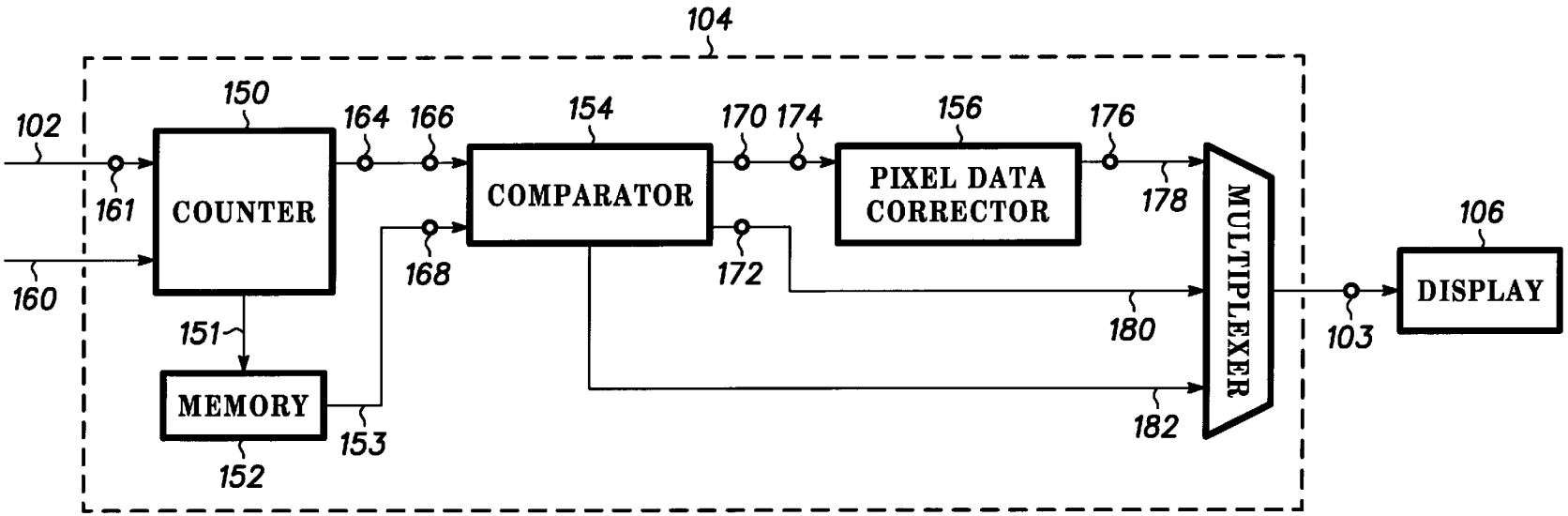
100 FIG. 3

METHOD FOR CONTROLLING SPACER VISIBILITY

FIELD OF THE INVENTION

The present invention relates to the area of field emission displays and, more particularly, to methods for controlling spacer visibility.

BACKGROUND OF THE INVENTION

It is known in the art to use spacer structures between the cathode and anode of a field emission display. The spacer structures maintain the separation between the cathode and the anode. They must also withstand the potential difference between the cathode and the anode.

However, spacers can adversely affect the flow of electrons toward the anode in the vicinity of the spacer. Some of the electrons emitted from the cathode can cause electrostatic charging of the surface of the spacer, changing the voltage distribution near the spacer from the desired voltage distribution. The change in voltage distribution near the spacer can result in distortion of the electron flow.

In a field emission display, this distortion of the electron flow proximate to spacers can result in distortions in the image produced by the display. In particular, the distortions can render the spacers "visible" by producing a dark region in the image at the location of each spacer or the distortions can produce a "bright spot" near the spacer.

Several prior art spacer structures attempt to solve the problems associated with spacer related electron flow distortion. These include spacers coated with a charge bleed layer, spacers made of high-capacitance materials and the placing of independently controlled electrodes along the height of the spacer for controlling the voltage distribution near the spacer. Coated spacers and spacers with independently controlled electrodes are susceptible to mechanical damage and/or alteration, such as may occur during the handling of the spacers. Coated spacers are also susceptible to chemical alteration, which may change their resistivity. These prior art methods also add additional processing steps and cost to field emission display fabrication. In addition, the prior art methods do not adequately eliminate the spacer visibility problem over the whole luminance range of the field emission display.

Accordingly, there exists a need for a method of controlling spacer visibility over the entire luminance range of the field emission display that eliminates the need for expensive and complex prior art methods of controlling spacer related electron flow distortion.

BRIEF DESCRIPTION OF THE DRAWINGS

Referring to the drawings:

FIG. 3 is a block diagram illustrating an embodiment of the invention.

DETAILED DESCRIPTION

An embodiment of the invention is for a field emission display with a spacer visibility correction circuit and method. An embodiment of the method of the invention can include the steps of receiving a video signal having pixel data indicating an intensity level of light to be generated by a plurality of pixels, comparing the pixel data to memory data to determine the pixel data to be transmitted to pixels proximate to a spacer, and modifying pixel data to be transmitted to pixels proximate to a spacer to render the spacer invisible to a viewer of a field emission display. Another embodiment of the invention includes a video signal having pixel data received by a field emission display and a spacer visibility correction circuit that modifies pixel data for transmission to pixels proximate to a spacer in order to render the spacer invisible to a viewer of the field emission display.

There are numerous advantages to the invention including the rendering of spacers invisible over the entire luminance range of the field emission display and the elimination of complex and expensive spacer coating methods that are used to prevent and remove charge buildup on a spacer. Together these advantages reduce both the complexity and cost of fabrication of the field emission display and provide a higher quality display image to a viewer of the field emission display.

Figure 1:
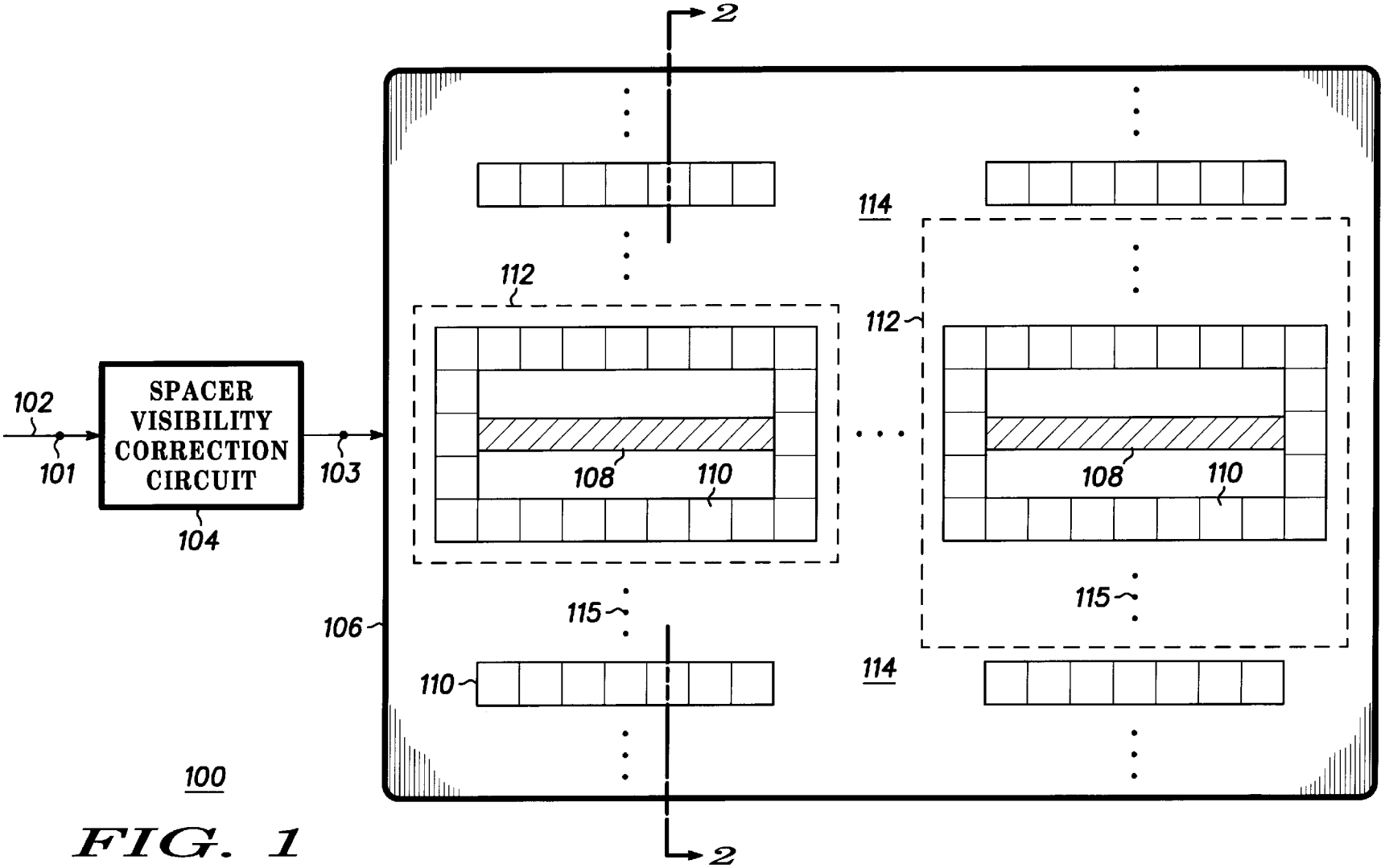
FIG. 1 is a plan view of a schematic representation of a field emission display in accordance with an embodiment of the invention.

FIG. 1 is a plan view of a schematic representation of a field emission display (FED) 100 in accordance with an embodiment of the invention. FED 100 includes a display 106 and a spacer visibility correction circuit 104. Display 106 includes a plurality of pixels 110 and a plurality of spacers 108. Plurality of pixels 110 are divided into a plurality of pixels 110 in a first region 112 and a plurality of pixels 110 in a second region 114. First region 112 is adjacent to spacer 108 and second region 114 is not adjacent to spacer 108. To facilitate understanding, FIG. 1 depicts only a few of the plurality of pixels 110 in both the first region 112 and second region 114. However, it is desired to be understood that any number of plurality of pixels 110 can be employed in first region 112 and second region 114. Linear sets of dots 115 indicate plurality of pixels 110 that can be included in first region 112 or second region 114 respectively, but have been omitted for clarity.

In one embodiment, plurality of pixels 110 in the first region 112 can be limited to plurality of pixels 110 immediately adjacent to spacer 108. In another embodiment, plurality of pixels 110 in the first region 112 can include plurality of pixels 110 immediately adjacent to spacer 108 and plurality of pixels 110 not adjacent to spacer 108. It is desired to be understood, that any combination of plurality of pixels 110 adjacent to spacer 108 and plurality of pixels 110 non-adjacent to spacer 108 can be included in first region 112. FIG. 1 depicts both embodiments where first region 112 includes only plurality of pixels 110 immediately adjacent to spacer 108 and where first region 112 includes plurality of pixels 110 both immediately adjacent and non-adjacent to spacer 108.

Spacer visibility correction circuit 104 includes an input 101 and an output 103. Input 101 of spacer visibility correction circuit 104 is connected to external electronics (not shown) and coupled for receiving a video signal 102 having pixel data. Video signal 102 can contain monochrome pixel data, red, green and blue pixel data, and the like. Output 103 of spacer visibility correction circuit 104 is connected to display 106 and coupled for transmitting pixel data to first region 112 and second region 114 of the field emission display 100.

Figure 2:
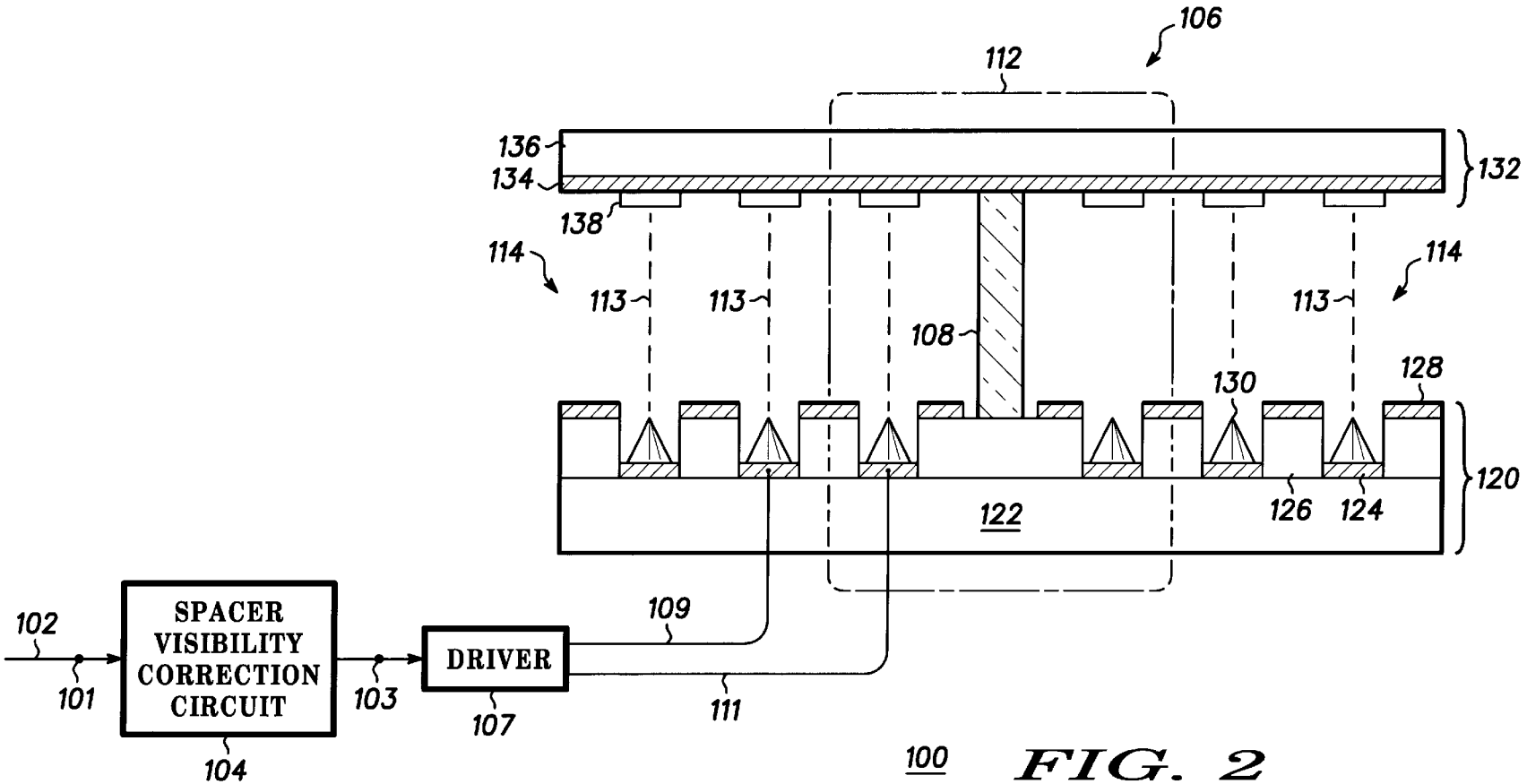
FIG. 2 is a cross-sectional view of the schematic representation of the field emission display of FIG. 1, taken along lines 2—2, in accordance with an embodiment of the invention.

FIG. 2 is a cross-sectional view of the schematic representation of the field emission display 100 of FIG. 1, taken along lines 2—2, in accordance with an embodiment of the invention. Display 106 includes a cathode plate 120 and an anode plate 132. Cathode plate 120 includes a substrate 122, which can be made from glass, silicon, and the like. Upon substrate 122 is disposed a plurality of cathodes 124, which can be formed from a thin layer of molybdenum. A dielectric layer 126 is formed on plurality of cathodes 124. Dielectric layer 126 can be made from, for example, silicon dioxide. Dielectric layer 126 defines a plurality of emitter wells, which contain one each a plurality of electron emitters 130. In the embodiment of FIG. 2, electron emitters 130 include Spindt tips.

However, a field emission display 100 in accordance with the invention is not limited to Spindt tip electron sources. For example, an emissive carbon film or nanotubes can alternatively be employed for the electron source of cathode plate 120.

Cathode plate 120 further includes a plurality of gate extraction electrodes 128. In general, gate extraction electrodes 128 are used to selectively address the electron emitters 130.

Anode plate 132 includes a transparent substrate 136, upon which is formed an anode 134. The anode 134 can include, for example, a thin layer of indium tin oxide, a layer of a metal glass mixture, and the like. A cathodoluminescent material, such as plurality of phosphors 138 is disposed upon anode 134. Electron emitters 130 selectively address phosphors 138. In a color field emission display, each of the plurality of phosphors 138 can include a red phosphor, a green phosphor and a blue phosphor. Each phosphor 138 is addressed by at least one electron emitter 130.

A pixel includes a phosphor 138 and at least one of a plurality of electron emitters 130 that address that phosphor 138. FIG. 2 depicts a single electron emitter 130 for each phosphor 138. However, it is desired to be understood, that any number of electron emitters 130 can address a phosphor 138 and therefore make up a pixel 110.

Display 106 further includes a driver 107. Driver 107 is connected to output 103 of spacer visibility correction circuit 104 to receive pixel data. Driver 107 has a first output 109 connected to cathode 124 to operate plurality of pixels 110 in first region 112, and a second output 111 connected to cathode 124 to operate plurality of pixels 110 in second region 114. FIG. 2 depicts only one driver first output 109 connected to pixels in first region 112 and one driver second output 111 connected pixels in second region 114. It is desired to be understood, that driver 107 has outputs to each cathode 124 in field emission display 100 and that further outputs were omitted from FIG. 2 for clarity.

In the embodiment shown in FIG. 2, driver 107 is a cathode driver because driver outputs are connected to the cathode 124. In another embodiment of the invention, driver 107 can be a gate extraction electrode 128 driver where driver outputs are connected to gate extraction electrodes 128. It is desired to be understood that the invention is not limited to a single cathode or gate extraction electrode driver. The invention can include any number of cathode and gate extraction electrode drivers.

During the operation of FED 100, and as is typical of triode operation in general, suitable voltages are applied to gate extraction electrodes 128, cathode 124, and anode 134 for selectively extracting electrons from electron emitters 130 and causing them to be directed toward anode 134 in order to create an electron current 113. A typical voltage configuration includes an anode voltage within the range of 100–10,000 volts; a gate extraction electrode voltage within a range of 10–100 volts; and a cathode potential below about 5–45 volts, typically at electrical ground.

FIG. 3 is a block diagram illustrating an embodiment of the invention. In the embodiment shown, field emission display 100 includes spacer visibility correction circuit 104 and display 106. Spacer visibility correction circuit 104 includes a counter 150 having an input 162 and an output 164, a memory 152 having memory data 153, a comparator 154 having a first input 166 and a second input 168 and a first output 170 and second output 172, a pixel data corrector 156 having an input 174 and an output 176 and a multiplexer 158. The counter input 162 is coupled for receiving a video signal 102 having pixel data and the counter output 164 is connected to the first input 166 of the comparator 154. Counter 150 also receives a clock signal 160 for timing the sequential addressing of plurality of pixels 110. The second input 168 of the comparator 154 is coupled to receive memory data 153 from memory 152. The first output 170 of the comparator 154 is connected to the pixel data corrector input 174. The second output 172 of the comparator 154 is connected to multiplexer 158 and coupled for transmitting second region pixel data 180 to the second region 114 of the field emission display 100. The pixel data corrector output 176 is connected to multiplexer 158 and coupled for transmitting first region pixel data 178 to the first region 112 of the field emission display 100.

In operation, a video signal 102 having pixel data indicating an intensity level of light to be generated by each of the plurality of pixels 110 in the first region 112 and second region 114 of the field emission display 100 is received at input 101 of spacer visibility correction circuit 104. The video signal 102 is received at counter input 162 while the counter 150 also receives a clock signal 160 for timing the sequential addressing of the plurality of pixels 110. The counter 150 transmits pixel addresses 151 to memory 152, wherein memory 152 already contains a pixel map for the particular display 106. Counter 150 transmits pixel data for each sequentially addressed pixel from counter output 164 to first input 166 of comparator 154.

Comparator 154 receives memory data 153 from memory 152 at second input 168. Memory data 153 contains pixel address locations which are obtained by combining and correlating the pixel map already stored in memory 152 and pixel addresses 151 received from counter 150. Pixel address 151 locations include each of the plurality of pixels 110 locations within either first region 112 or second region 114 of display 106. Comparator 154 utilizes memory data 153 from memory 152 to determine if the pixel data for each of the plurality of pixels 110 corresponds to a pixel located in first region 112 or second region 114 of display 106. Thus, comparator 154 performs the function of deciding whether data for each pixel of plurality of pixels 110 corresponds to a pixel located in a region adjacent to spacer 108 or in a region non-adjacent to spacer 108.

Comparator second output 172 transmits second region pixel data 180 to multiplexer 158. Comparator first output 170 transmits pixel data corresponding to plurality of pixels 110 located in first region 112 to pixel data corrector input 174. Pixel data corrector 156 modifies pixel data for transmission to the first region 112 of display 106 to correspond to the intensity level of light generated by plurality of pixels in the first region 112 in order to render spacer 108 invisible to a viewer of the field emission display 100. Pixel data corrector 156 transmits first region pixel data 178 to multiplexer 158. Multiplexer 158 utilizes a first region/second region signal 182 from comparator 154 to select first region pixel data 178 or second region pixel data 180 for transmission to display 106 through spacer visibility correction circuit output 103.

In an embodiment of the invention, pixel data corrector 156 can include an arithmetic logic unit (ALU) having a programmable computation algorithm. The algorithm is user defined to correspond to particular characteristics of display 106 such as, number of pixels, spacer 108 layout, type of spacers, and the like. The programmable computation algorithm can be for a monochrome or multi-color display and can be developed by plotting a curve of relative intensity level of light versus the brightness range for plurality of pixels 110 located in first region 112 of display 106. Utilizing this curve, the deviation of actual pixel intensity level of light from the desired pixel intensity level of light for plurality of pixels 110 in first region 112 is determined and a function developed. The resulting function can be input to the ALU as an algorithm and be used to modify the intensity level of light of plurality of pixels 110 located in first region 112 in order to render spacer 108 invisible to a viewer of display 106.

In one embodiment, modifying pixel data for transmission to first region 112 includes reducing the intensity level of light generated by the plurality of pixels 110 in the first region 112. This can correspond to reducing the pulse width corresponding to the pixel data for transmission to the first region 112. In another embodiment, modifying pixel data for transmission to the first region 112 includes increasing the intensity level of light generated by the plurality of pixels 110 in the first region 112. This can correspond to increasing the pulse width corresponding to the pixel data for transmission to the first region 112.

For example, in an embodiment of the invention, a multi-colored field emission display 100 with a 240 by 960 pixel display, with spacers 108 having a dielectric constant of approximately 85 has a programmable computation algorithm as follows:

$$R' \approx R/2+R/4-R/16$$

$$G' \approx G/2+G/4-G/16$$

$$B' \approx B/2+B/4-B/16$$

wherein R, G and B are red, blue and green pixel data respectively, for transmission to first region 112, and R', G' and B' are red, green and blue first region pixel data 178 respectively, for transmission to the first region 112 of the field emission display 100. In this embodiment, the brightness of plurality of pixels 110 located in first region 112 is reduced by reducing the pulse width in order to render spacer 108 invisible to a viewer of the field emission display 100.

In another embodiment of the invention, pixel data corrector 156 can include a look-up table. In yet another embodiment, pixel data corrector 156 can include a circuit to reduce or increase the pulse width of pixel data for transmission to first region 112.

The invention is not limited to plurality of pixels 110 divided into a first region 112 and a second region 114. The invention can include dividing plurality of pixels 110 into any number of regions. The invention is not limited to field emission displays. In general, the invention is useful for any matrix-addressable display such as plasma displays, and the like.

In summary, it should now be appreciated that the present invention provides for a field emission display with a spacer visibility correction circuit and method. The invention has the advantage of rendering spacers invisible over the entire luminance range of a field emission display and the elimination of complex and expensive spacer coating methods that are used to prevent and remove charge buildup on the spacer. Together these advantages reduce both the complexity and cost of fabrication of the field emission display and provide a higher quality display image to a viewer of the field emission display.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. A method for controlling spacer visibility in a field emission display (100) comprising the steps of:

providing a display (106) having a plurality of pixels (110) in a first region (112) and a plurality of pixels (110) in a second region (114), wherein the first region (112) is adjacent to a spacer (108) and the second region (114) is not adjacent to the spacer (108);

providing a memory (152) having memory data (153);

receiving a video signal (102) having pixel data indicating an intensity level of light to be generated by each of the plurality of pixels (110) in the first and second regions (112, 114) of the display (106);

comparing the pixel data to the memory data (153) to determine the pixel data to be transmitted to the plurality of pixels (110) in the first and second regions (112, 114) of the display (106), wherein the pixel data to be transmitted to the second region (114) defines a second region pixel data (180);

transmitting the second region pixel data (180) to the second region (114) of the display (106); and modifying the pixel data for transmission to the first region (112) of the display (106) to correspond to the intensity level of light generated by the plurality of pixels (110) in the first region (112) in order to render the spacer (108) invisible to a viewer of the field emission display (100), wherein the pixel data to be transmitted to the first region defines a first region pixel data (178).

2. The method of claim 1, wherein the step of modifying the pixel data for transmission to the first region (112) further comprises the step of reducing the intensity level of light generated by the plurality of pixels (110) in the first region (112) in order to render the spacer (108) invisible to a viewer of the display (106).

3. The method of claim 1, wherein the step of modifying the pixel data for transmission to the first region (112) comprises the step of reducing a pulse width corresponding to the pixel data for transmission to the first region (112).

4. The method of claim 1, wherein the step of modifying the pixel data for transmission to the first region (112) further comprises the step of increasing the intensity level of light generated by the plurality of pixels (110) in the first region (112) in order to render the spacer (108) invisible to a viewer of the display (106).

5. The method of claim 1, wherein the step of modifying the pixel data for transmission to the first region (112) comprises the step of increasing a pulse width corresponding to the pixel data for transmission to the first region (112).

6. The method of claim 1, wherein the step of receiving a video signal (102) having pixel data includes the step of receiving a video signal (102) having red, green and blue pixel data.

7. The method of claim 1, wherein the step of modifying the pixel data includes the step of providing an arithmetic logic unit having a programmable computation algorithm.

8. The method of claim 7, further comprising the step of providing an arithmetic logic unit having a programmable computation algorithm as follows:

$$R' \approx R/2+R/4-R/16$$

$$G' \approx G/2+G/4-G/16$$

$$B' \approx B/2+B/4-B/16$$

wherein R, G and B are red, blue and green pixel data respectively, for transmission to the first region (112), and R', G' and B' are red, green and blue first region pixel data respectively, for transmission to the first region (112) of the field emission display (100).

9. The method of claim 1, wherein the step of modifying the pixel data includes the step of providing a look-up table.

10. A field emission display (100) comprising:

a plurality of pixels (110) in a first region (112) and a plurality of pixels (110) in a second region (114), wherein the first region (112) is adjacent to a spacer (108) and the second region (114) is not adjacent to the spacer (108);

a video signal (102) having pixel data indicating an intensity level of light to be generated by each of the plurality of pixels (110) in the first and second regions (112, 114) of the field emission display (100); and a spacer visibility correction circuit (104) having an input (101) and an output (103), wherein the input (101) is coupled for receiving the video signal (102) having pixel data and the output (103) is coupled for transmitting a first region pixel data (178) to the plurality of pixels (110) in the first region (112) and a second region pixel data (180) to the plurality of pixels (110) in the second region (114) of the field emission display (100) in order to render the spacer (108) invisible to a viewer of the field emission display (100).

11. The field emission display (100) as claimed in claim 10, wherein the spacer visibility correction circuit (104) further comprises a counter (150) having an input (162) and an output (164), a memory (152) having memory data (153), a comparator (154) having first (166) and second inputs (168) and first (170) and second outputs (172) and a pixel data corrector (156) having an input (174) and an output (176), wherein the input (162) of the counter (150) is coupled for receiving the video signal (102) and the output (164) is connected to the first input (166) of the comparator (154), wherein the second input (168) of the comparator (154) is coupled to receive memory data (153), wherein the first output (170) of the comparator (154) is connected to the input (174) of the pixel data corrector (156) and the second output (172) of the comparator (154) is coupled for transmitting the second region pixel data (180) to the second region (114) of the field emission display (100), and wherein the output (176) of the pixel data corrector (156) is coupled for transmitting the first region pixel data (178) to the first region (112) of the field emission display (100).

12. The field emission display (100) as claimed in claim 11, wherein the counter (150) receives the video signal (102) and transmits the pixel data to the comparator (154), wherein the comparator (154) compares pixel data with the memory data (153) to determine the pixel data to be transmitted to the plurality of pixels (110) in the first and second regions (112, 114) of the field emission display (100), wherein the comparator (154) transmits the second region pixel data (180) to the second region (114), and wherein the pixel data corrector (156) modifies the pixel data for transmission to the first region (112) to correspond to the intensity level of light generated by the plurality of pixels (110) in the first region (112) in order to render the spacer (108) invisible to the viewer of the field emission display (100).

13. The field emission display (100) as claimed in claim 12, wherein the pixel data corrector (156) comprises an arithmetic logic unit having a programmable computation algorithm.

14. The field emission display (100) as claimed in claim 13, further comprising an arithmetic logic unit having a programmable computation algorithm as follows:

$$R' \approx R/2+R/4-R/16$$

$$G' \approx G/2+G/4-G/16$$

$$B' \approx B/2+B/4-B/16$$

wherein R, G and B are red, blue and green pixel data respectively, for transmission to the first region (112), and R', G' and B' are red, green and blue first region pixel data (178) respectively, for transmission to the first region (112) of the field emission display (100).

15. The field emission display (100) as claimed in claim 12, wherein the pixel data corrector (156) comprises a look-up table.

16. The field emission display (100) as claimed in claim 12, wherein the pixel data corrector (156) reduces the intensity level of light generated by the plurality of pixels (110) in the first region (112) in order to render the spacer (108) invisible to the viewer of the field emission display (100).

17. The field emission display (100) as claimed in claim 12, wherein the pixel data corrector (156) reduces a pulse width corresponding to the first region pixel data (178) for transmission to the first region (112).

18. The field emission display (100) as claimed in claim 12, wherein the pixel data corrector (156) increases the intensity level of light generated by the plurality of pixels (110) in the first region (112) in order to render the spacer (108) invisible to the viewer of the field emission display (100).

19. The field emission display (100) as claimed in claim 12, wherein the pixel data corrector (156) increases a pulse width corresponding to the first region pixel data (178) for transmission to the first region (112).

* * * * *